US005749065A

United States Patent [19]

Nishiguchi et al.

[11] Patent Number: 5,749,065

[45] Date of Patent: May 5, 1998

[54] SPEECH ENCODING METHOD, SPEECH DECODING METHOD AND SPEECH ENCODING/DECODING METHOD

[75] Inventors: Masayuki Nishiguchi; Jun Matsumoto, both of Kanagawa, Japan

[73] Assignee: Sony Corporation, Tokyo, Japan

[21] Appl. No.: 518,298

[22] Filed: Aug. 23, 1995

[30] Foreign Application Priority Data

Aug. 30, 1994 [JP] Japan ..... 6-205284

[51] Int. Cl.[6] ..... G10L 3/02; G10L 9/00

[52] U.S. Cl. ..... 704/219; 704/222

[58] Field of Search ..... 395/2.14, 2.16, 395/2.17, 2.2, 2.23, 2.28, 2.29, 2.31

[56] References Cited

U.S. PATENT DOCUMENTS

| | | | |
|---|---|---|---|
| 5,226,084 | 7/1993 | Hradwick et al. | 395/2.29 |
| 5,293,448 | 3/1994 | Honda | 395/2.17 |
| 5,293,449 | 3/1994 | Tzeng | 395/2.32 |
| 5,473,727 | 12/1995 | Nishiguchi et al. | 395/2.31 |
| 5,488,704 | 1/1996 | Fujimoto | 395/2.28 |

OTHER PUBLICATIONS

Nishiguchi et al., "Vector Quantized MBE With Simplified V/UV Division At 3.0 KBPS" ICASSP '93, pp. II-151—II154.

Yeldener et al., "High Quality Multiband LPC Coding of Speech at 2.4 kbps", Electronics Letters, 4th Jul. 1991, vol. 27 No.14, pp. 1287–1289.

Meuse, "A 2400 bps Multi-Band Excitation Vocoder" ICASSP '90, pp. 9–12.

Yang et al., " A 5.4 kbps Speech Coder Based on Multi--Band Excitation and Linear Predictive Coding" TENCON '94, pp. 417–421.

Haagen et al., " A 2.4 KBPS high Quality Speech Coder", ICASSP '91, pp. 589–592.

*Primary Examiner*—Allen R. MacDonald
*Assistant Examiner*—Patrick N. Edouard
*Attorney, Agent, or Firm*—Jay H. Maioli

[57] ABSTRACT

A speech encoding/decoding method calculates a short-term prediction error of an input speech signal that is divided on a time axis into blocks, represents the short-term prediction residue by a synthesized sine wave and a noise and encodes a frequency spectrum of each of the synthesized sine wave and the noise to encode the speech signal. The speech encoding/decoding method decodes the speech signal on a block basis and finds a short-term prediction residue waveform by sine wave synthesis and noise synthesis of the encoded speech signal. The speech encoding/decoding method then synthesizes the time-axis waveform signal based on the short-term prediction residue waveform of the encoded speech signal.

39 Claims, 8 Drawing Sheets

SPEECH ENCODING METHOD, SPEECH DECODING METHOD AND SPEECH ENCODING/DECODING METHOD

BACKGROUND

1. Field of the Invention

This invention relates to a speech encoding method, a speech decoding method and a speech encoding/decoding method. More particularly, it relates to a speech encoding method consisting in classifying an input speech signal into blocks and encoding the input speech signal in terms of the blocks as units, a speech decoding method consisting in decoding the speech encoded in this manner, and a speech encoding/decoding method.

2. Background of the Invention

There have hitherto been known a variety of encoding methods consisting in compressing audio signals, inclusive of speech and acoustic signals, by taking advantage of statistic properties of the signals in the time domain or frequency domain thereof and psychoacoustic characteristics of the human hearing system. These encoding methods may be roughly classified into encoding in the time domain, encoding in the frequency domain and encoding by analysis/synthesis.

If, in high efficiency encoding for speech signals, typified by multi-band excitation (MBE), single-band excitation (SBE), harmonic encoding, sub-band coding (SBC), linear predictive coding (LPC), discrete cosine transform (DCT), modified DCT (MDCT) or fast Fourier transform (FFT), it is desired to quantize various information data, such as amplitudes of spectral components or parameters thereof, such as LSP-, $\alpha$- or k-parameters, the conventional practice is generally to use scalar quantization.

With the speech analysis/synthesis system, such as the PARCOR method, the timing of switching the excitation source is based on a block (frame) on the time axis. Consequently, the voiced sound and the unvoiced sound cannot co-exist in the same frame, so that the high-quality speech cannot be produced.

Conversely, with MBE, voiced/unvoiced discrimination (V/UV discrimination) is carried out for the one-block speech (one-frame speech) for each of frequency bands composed of respective harmonics or two to three harmonics in the frequency spectrum grouped together, or frequency bands of fixed bandwidths, such as 300 to 400 Hz, based upon the shape of the spectral envelope in each frequency band. In such case, the speech quality is noticeably improved. This band-based U/UV discrimination is carried out based mainly upon observation of the degree of intensity of the harmonics in the spectrum in the band.

With MBE, it has been pointed out that the increased quantity of arithmetic-logical operations leads to an increased load on the hardware for arithmetic-logical operations and software. If spontaneous speech is to be obtained as the playback signal, the number of bits of the amplitude of the spectral envelope cannot be reduced excessively, while the phase information is transmitted. In addition, the synthesized speech by MBE conveys a characteristic "stuffed" feeling to the listener.

SUMMARY OF THE INVENTION

It is therefore an object of the present invention to provide a speech encoding method which resolves the above problem.

It is another object of the present invention to provide a speech decoding method which resolves the above problem.

It is still another object of the present invention to provide a speech encoding/decoding method which resolves the above problem.

According to the present invention, there is provided a speech encoding method for dividing an input speech signal into blocks on the time axis and encoding the signal on the block basis. The method includes the steps of finding a short-term prediction residue of the input speech signal, representing the short-term prediction residue as found by a synthesized sine wave and the noise, and encoding the information of the frequency spectrum of each of the synthesized sine wave and the noise.

According to the present invention, there is also provided a method for decoding the speech in which the short-term prediction residue of the input speech signal is found and divided on the time axis on the block basis, the short-term prediction residue thus found is represented by a synthesized sine wave and the noise on the block basis and in which the information on the frequency spectrum of each of the synthesized sine wave and the noise is encoded to form an encoded speech signal, which is decoded. The method includes the steps of finding a short-term prediction residual waveform by sine wave synthesis and noise synthesis for the encoded speech signal and synthesizing a time-axis waveform signal based upon the short-term residual waveform thus found.

According to the present invention, there is also provided a speech encoding/decoding method including the steps of dividing the input speech signal on the time axis into blocks and encoded on the block basis, and decoding the encoded speech signal. The encoding step includes sub-steps of finding the short-term prediction residue of the input speech signal, representing the short-term prediction residue by a synthesized sine wave and the noise, and encoding the information on the frequency spectrum of each of the synthesized sine wave and the noise. The decoding step includes the sub-steps of finding the short-term prediction residual waveform of the encoded speech signal by sine wave synthesis and noise synthesis and synthesizing a time-axis waveform signal based upon the short-term prediction residual waveform thus found.

According to the present invention, there is also provided a speech encoding apparatus for dividing an input speech signal into blocks on the time axis and encoding the signal on the block basis. The apparatus includes arithmetic-logical means for finding a short-term prediction residue of the input speech signal, an analysis/synthesis means for representing the short-term prediction residue by a synthesized sine wave and the noise and encoding means for encoding the information of the frequency spectrum of each of the synthesized sine wave and the noise.

According to the present invention, there is also provided a speech decoding apparatus in which the short-term prediction residue of the input speech signal is found and divided on the time axis on the block basis, the short-term prediction residue thus found out is represented by a synthesized sine wave and the noise on the block basis and in which the information on the frequency spectrum of each of the synthesized sine wave and the noise is encoded to form an encoded speech signal, which is decoded. The apparatus includes arithmetic-logical means for finding a short-term prediction residual waveform by sine wave synthesis and noise synthesis for the encoded speech signal and synthesizing means for synthesizing a time-axis waveform signal based upon the short-term residual waveform thus found.

According to the present invention, since the short-term prediction residue such as the LPC residue of the input speech signal are represented by MBE analysis by a synthesized sine wave and the noise, and the frequency spectrum of each of the synthesized sine wave and the noise is encoded, the short-term prediction residue signal resulting from the analysis and synthesis by MBE represents a substantially flat spectral envelope. Thus the vector quantization or matrix quantization with a smaller number of bits results in a smooth synthesized waveform while the output of the synthesis filter on the decoder side is of soft sound quality. Since the LPC synthesis filter of minimum movement transition is used during synthesis, the ultimate output is substantially of the minimum phase so that the "stuffed" feeling proper to MBE is hardly noticed and the synthesized speech with high clarity is produced. The probability of the quantization error being enlarged at the time of dimensional conversion of vector quantization or matrix quantization is also diminished thus raising the quantization efficiency.

By discriminating whether the input speech signal is voiced or unvoiced, and by outputting the information specifying the characteristic quantity of the LPC residual waveform in place of the pitch information for the unvoiced portion of the input speech signal, waveform changes during the time period shorter than the block duration can be known on the synthesis side so that the unclear feeling of the consonant sound or the feeling of reverberation can be eliminated. Since there is no necessity of transmitting the pitch information during the block found to be unvoiced, the information concerning the characteristic quantity of the time waveform of the unvoiced sound may be introduced into a slot inherently used for sending the pitch information, thereby raising the quality of the playback sound (synthesized sound) without increasing the quantity of data transmitted.

On the other hand, by quantizing the frequency spectrum of the short-term prediction residues by vector or matrix quantization with weighting designed for taking account of characteristics of the human hearing system, optimum quantization taking into account the masking effect or the like may be achieved depending on the properties of the input signal. By employing the weighting coefficient of past blocks for weighting for taking account of characteristics of the human hearing system in calculating the current weighting coefficient, the weighting taking into account the temporal masking may be found for further raising the quality of quantization.

By separating the codebook for quantization into a codebook for male speech and a codebook for female speech, it becomes possible to separate the training of the codebook for voiced speech and that of the codebook for unvoiced speech for diminishing the expected value of the output distortion.

By employing a codebook for male speech and a codebook for female speech, separately optimized for the male speech and for the female speech, respectively, as the codebook used for matrix quantization or vector quantization of parameters for LPC coefficients or the frequency spectrum of the short-term prediction residues, and by selectively switching between the codebook for male speech and that for the female speech depending on whether the input speech signal is the male speech or the female speech, optimum quantization characteristics can be produced with a smaller number of bits.

BACKGROUND OF THE INVENTION

Figure 1:
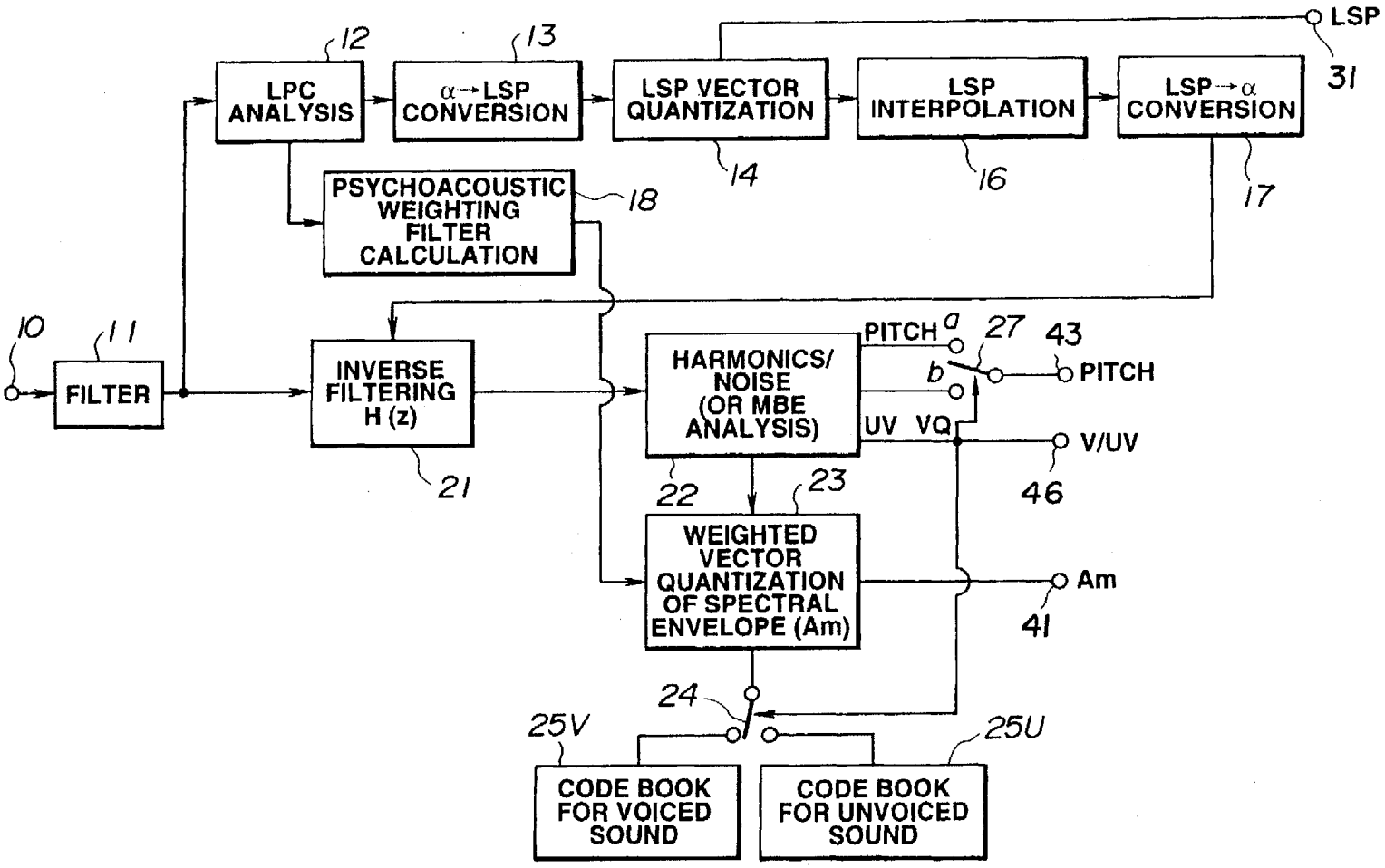
FIG. 1 is a schematic block diagram showing a speech signal encoder (encoding apparatus) for carrying out the encoding method according to the present invention.

Referring to the drawings, preferred illustrative embodiments of the present invention will be explained in detail.

FIG. 1 schematically shows an encoder for carrying out the encoding method according to the present invention.

The basic concept of a system made up of the speech signal encoder of FIG. 1 and a speech signal decoder of FIG. 7 as later explained resides in that the short-term prediction residue, for example, the residue of linear prediction coding (LPC residue), is represented by harmonics coding and noise, or encoded or analyzed by MBE.

In conventional encoding by code excitation linear prediction (CELP), the LPC residues are directly formed into a time-axis waveform which is quantized by vector quantization. With the present embodiment, the residues are encoded by harmonics coding or analyzed by MBE, so that, even if the amplitudes of the spectral envelope of the harmonics is vector quantized, a smoother waveform is produced by synthesis on vector quantization, while the filter output of the synthesized waveform by LPC is of an extremely soft sound quality. Meanwhile, the amplitudes of the spectral envelope are quantized by vector quantization with a preset number of dimensions obtained by dimensional conversion as proposed in our co-pending JP Patent Publication JP-A-6-51800 or the technique of converting the number of data.

In the speech signal encoder, shown in FIG. 1, speech signals supplied to an input terminal 10 is filtered by a filter 11 for removing signals of unnecessary bands and thence supplied to a linear predictive coding analysis (LPC analysis) circuit 12 and an inverse filtering circuit 21.

The LPC analysis, circuit 12 multiplies the input signal waveform with a Hamming window set, in terms of a length on the order of 256 samples of the input signal waveform as a block, in order to find a linear prediction coefficient, or a so-called α-parameter, by an auto-correlation method. The framing interval as a unit of data output is on the order of 160 samples. With the sampling frequency fs of e.g., 8 kHz, the one-frame interval is 160 samples or 20 msec.

The α-parameter from the LPC analysis circuit 12 is sent to an a to LSP converting circuit 13 so as to be converted into a linear spectrum pair (LSP) parameter. This converts the α-parameter, as found by a direct type filter coefficient, into e.g., ten, that is five pairs of, LSP parameters. The conversion is done by e.g., a Newton-Rapson method. The reason the α-parameter is converted into the LSP parameter is that the latter is superior to the α-parameter in interpolation characteristics.

The LSP parameter from the α to LSP converting circuit 13 is vector-quantized by an LSP vector quantizer 14. The frame-to-frame difference may also be taken and vector-quantized, or a plurality of frames may be grouped together and vector-quantized. For quantization, each frame is 20 msec and the LSP parameters calculated every 20 msecs are vector-quantized.

A quantized output from the LSP vector quantizer 14, that is the index of the LSP vector quantization, is taken out at a terminal 31. The quantized LSP vector is sent to an LSP interpolation circuit 16.

The LSP interpolation circuit 16 interpolates the LSP vectors resulting from vector quantization every 20 msecs in order to provide an eight-fold rate. That is, the LSP vector is updated every 2.5 msecs. The reason is that, if the residual waveform is analyzed and synthesized by the MBE encoding/decoding method, the synthesized waveform presents an extremely smooth envelope, so that, if the LPC coefficient is changed acutely for every 20 msecs, foreign sounds may occasionally be produced. Such foreign sounds may be prevented from being produced if the LPC coefficients are changed gradually every 2.5 msecs.

For back-filtering the input speech using the LSP vector interpolated and updated every 2.5 msecs, the LSP parameter is converted by an LSP to a converting circuit 17 into an α-parameter which is a coefficient of a direct type filter with the number of orders being e.g., 10. An output of the LSP to a converter 17 is sent to a back-filtering circuit 21 which then carries out back-filtering using an ≧-parameter updated every 2.5 msecs for producing a smooth output. The output of the back-filtering circuit 21 is sent to a harmonics/noise encoding circuit, specifically, an MBE analysis circuit 22.

The harmonics/noise encoding circuit or the MBE analysis circuit 22 analyzes the output of the back-filtering circuit 21 by a method for analysis similar to MBE analysis. That is, the MBE analysis circuit 22 carries out pitch detection, calculation of amplitudes (Am) of the respective harmonics or V/UV discrimination, and provides for a constant number of the amplitudes of the harmonics changed with the varying pitch by dimension conversion. For pitch detection, auto-correlation of the input LPC residues is utilized, as will be explained subsequently.

Figure 2:
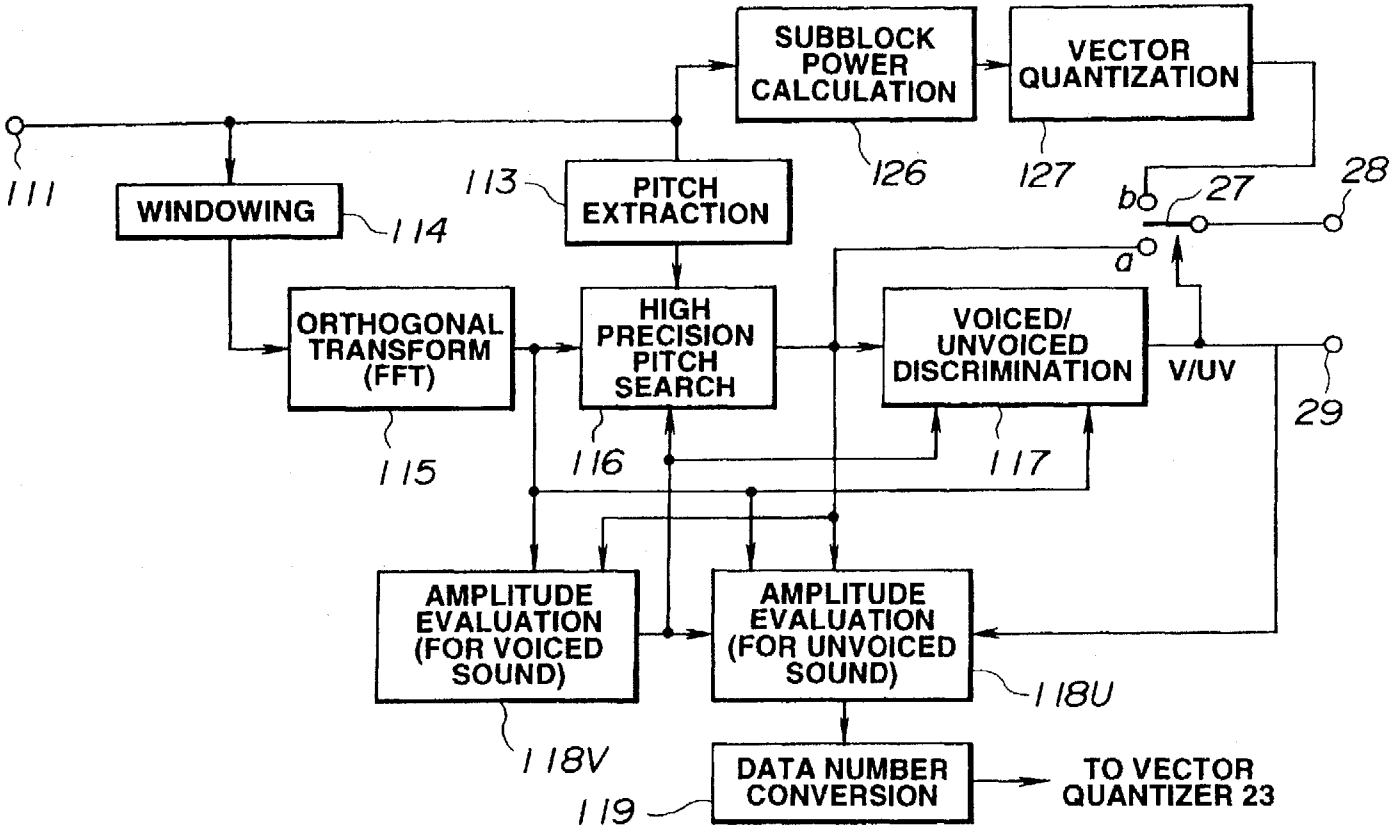
FIG. 2 is a block diagram showing the construction of a multi-band excitation (MBE) analysis circuit as an illustrative example of a harmonics/noise encoding circuit employed in FIG. 1.

Referring to FIG. 2, an illustrative example of an analysis circuit by multi-band excitation (MBE) encoding such as circuit 22 is explained.

The MBE analysis circuit shown in FIG. 2 executes modelling on an assumption that both a voiced portion and an unvoiced portion exist in the frequency domain of the same time moment, that is in the same block or frame.

Referring to FIG. 2, linear prediction residues or LPC residues from the back-filtering circuit 21 are sent to an input terminal 111 of FIG. 2. It is on the input of the LPC residues that MBE analysis and encoding is executed.

The LPC residues entering the input terminal 111 are sent to a pitch extracting unit 113, a windowing unit 114 and a sub-block power calculating unit 126.

Since the input to the pitch extracting unit 113 is the LPC residue, the circuit 113 executes pitch detection by detecting the maximum value of auto-correlation of the residues. The pitch extracting unit 113 carries out relatively rough pitch search by an open loop. The extracted pitch data is sent to a fine pitch search unit 116 so as to undergo fine pitch search by the closed loop.

The windowing unit 114 multiplies a one-block of N samples with a pre-set window function, such as a Humming window, and shifts the windowed block along the time axis at a rate of one frame of L samples. The time-axis data string from the windowing unit 114 is orthogonally transformed by e.g., fast Fourier transform (FFT) by an orthogonal transform unit 115.

A sub-block power calculating unit 126 extracts a characteristic quantity specifying an envelope of the time waveform of the unvoiced sound signal of a given block when the totality of bands in the block have been judged to be unvoiced (UV).

The fine pitch search unit 116 is supplied with rough pitch data of an integer value as extracted by the pitch extracting unit 113 and with frequency-domain data produced by e.g., FFT by the orthogonal transform unit 115. The fine pitch search unit 116 executes swinging by ± several samples at an interval of 0.2 to 0.5 about the rough pitch data as center in order to derive the value of the fine pitch data having an optimum decimal point (floating point). As the fine search technique, the analysis-by-synthesis method is used, and the pitch is selected so that the power spectrum resulting from analysis closest to the power spectrum of the original sound will be produced.

That is, several pitch values larger and smaller than the rough pitch as found by the pitch extracting unit 113, at intervals of e.g. 0.25, are provided. For each of the plural pitches having minutely different values, the error sum $\Sigma\epsilon_m$ is found. If the pitch is set, the bandwidth is set, such that it becomes possible to find the error $\epsilon_m$ using the power spectrum of the frequency-axis data and the spectrum of the excitation signal in order to find the sum $\Sigma\epsilon_m$ for the band. The error sum $\Sigma\epsilon_m$ is found for each pitch and a pitch corresponding to the least error sum is selected as being an optimum pitch. The optimum fine pitch (with e.g., an interval of 0.25) is found in this manner by the fine pitch search unit and an amplitude corresponding to the optimum pitch $|A_m|$ is found. The calculations for the amplitude value are carried out by an amplitude evaluation unit for the voiced sound 118V.

In the foregoing explanation of the fine pitch search, it is assumed that the totality of the bands are voiced. However, since the MBE analysis synthesis system employs a model which presupposes the presence of an unvoiced area on the frequency axis at the same time instant, as previously described, it is necessary to carry out V/UV discrimination for each band.

The data of the optimum pitch from the fine pitch search unit 116 and the amplitude $|A_m|$ from the amplitude evaluation unit for the voiced sound 118V are sent to a voiced/unvoiced discrimination unit 117 where the V/UV discrimination is carried out from band to band. The noise to signal ratio NSR is used for this discrimination.

It should be noted that the number of bands divided by the basic pitch frequency, that is the number of harmonics, is varied approximately in a range of from 8 to 63, as described above, depending on the speech level, that is the magnitude of pitch, so that the number of V/UV flags is similarly fluctuated from band to band. Thus, with the present embodiment, the results of V/UV discrimination are grouped or degraded at an interval of a pre-set number of bands divided by a fixed frequency bandwidth. Specifically, a pre-set frequency range of e.g., 0 to 4000 Hz, including the speech range, is divided into $N_B$ bands, e.g., 12 bands, and the weighted mean values in each band is discriminated by a pre-set threshold $Th_2$ in accordance with the NSR in each band for discriminating the V/UV in the band.

An amplitude evaluating unit 118U for the unvoiced sound is supplied with frequency-domain data from the orthogonal transform unit 115, fine pitch data from the fine pitch unit 116, the amplitude data $|A_m|$ from the voiced sound amplitude evaluating unit 118V and the V/UV discrimination data from the V/UV discriminating unit 117. The amplitude evaluating unit for the unvoiced sound 118U again finds the amplitude for the band, found to be unvoiced (UV) by the V/UV discriminating unit 117, by way of amplitude re-evaluation.

The data from the amplitude evaluation unit for the unvoiced sound 118U is sent to a data number converting unit 119 which is a sort of a sampling rate converting unit. The data number conversion unit 119 provides for a constant number of data, above all, amplitude data, in consideration that the number of divided bands on the frequency axis and hence the number of data, above all, amplitude data, differ with the pitch. That is, if the effective bandwidth is up to 3400 kHz, this effective band is divided into 8 to 63 bands depending on the pitch so that the number $m_{MX}+1$, of the amplitude data $|A_m|$ obtained in each band, inclusive of the amplitude data $|A_m|_{UV}$, is also changed from 8 to 63. Thus the data number conversion unit 119 converts variable number $m_{MX}+1$ of the amplitude data into a constant number, such as 44.

In the present embodiment, dummy data is appended to amplitude data for one block of the effective band on the frequency axis for interpolating the values from the last data in the block up to the first data in the block in order to increase the number of data to $N_F$. The resulting data is processed with band limiting type over-sampling with a factor of $O_S$) such as eight, to give a number of amplitude data equal to $(m_{MX}+1)\times O_S$. The resulting amplitude data are linearly interpolated to give a larger number $N_M$, such as 2048, of amplitude data, which are then converted to the pre-set constant number M, such as 44, of amplitude data.

The data from the data number conversion unit 119, that is the constant number M of the amplitude data, is sent to the vector quantizer 23 so as to be grouped into vectors each composed of a pre-set number of data which are then quantized by vector quantization.

The pitch data from the fine pitch search unit 116 is sent to an output terminal 43 via a fixed terminal a of the changeover switch 27 to the output terminal 43. That is, if the entire bands in a given block are found to be unvoiced such that the pitch information becomes redundant, the information of a characteristic quantity specifying the time waveform of the unvoiced signal is transmitted in place of the pitch information. This technique is elucidated in JP Patent Application No. 5-185325 (JP Patent Publication JP-A-7-44194).

These data may be obtained by processing data in a block of N-samples, e.g., 256 samples. Since the block proceeds on the time axis in terms of a frame composed of L samples as a unit, the transmitted data is obtained on the frame basis. That is, the pitch data, V/UV discrimination data and the amplitude data are updated with the frame period. As the V/UV discrimination data from the V/UV discrimination unit 117, data degraded to e.g., 12 bands may be employed, as previously explained. Data specifying one or less V/UV separation position in the entire band may also be employed. Alternatively, the entire band may be expressed by one of V or UV bands. Alternatively, V/UV discrimination may also be carried out on the frame basis.

If a block in its entirety is found to be UV, one block of e.g., 256 samples is divided into a plurality of, herein eight, sub-blocks, made up of e.g., 32 samples, for extracting a characteristic quantity representative of the time waveform in the block. The resulting sub-blocks are sent to a sub-block power calculating unit 126.

The sub-block power calculating unit 126 calculates the average power of a sample in each sub-block or an average power or the ratio to the average RMS value of the entire samples in the block, such as 256 samples.

That is, the average power of e.g., the k'th sub-block is found and the average power of the one block in its entirety is found. Then, a square root of the average power for one block and the average power p(k) of the k'th sub-block is calculated.

The square root thus found is deemed to be a vector of a pre-set dimension and vector-quantized at the next vector quantizer 127.

The vector quantizer 127 executes straight vector quantization with 8 dimensions by 8 bits, with the codebook size being 256. An output index UVE of the vector quantization (code of the representative vector) is sent to a fixed terminal b of the changeover switch 27, the fixed terminal a of which is fed with the pitch data from the fine pitch search unit 116. An output of the changeover switch 27 is sent to the output terminal 43.

The changeover switch 27 is changed over by a discrimination output signal from the V/UV discriminating unit 117. Thus the changeover switch 27 is set to the fixed terminals a and b when at least one of the bands in the block is found to be voiced and all of the bands of the block are found to be unvoiced, respectively.

Thus a vector quantization output of the normalized averaged RMS value for each sub-block is inherently transmitted by being introduced in a slot which inherently transmits the pitch information. That is, if the entire bands in a block have been found to be unvoiced, the pitch information is unnecessary. In such case, the V/UV discrimination flag from the V/UV discrimination unit 117 is checked so that the vector quantization output index UVE is transmitted in place of the pitch information only when the entire bands are unvoiced.

Returning to FIG. 1, the weighting vector quantization of a spectral envelope (Am) in the vector quantizer 23 is explained.

The vector quantizer 23 is of 2-stage construction with L-vector elements, e.g., 44 vector elements.

Figure 3:
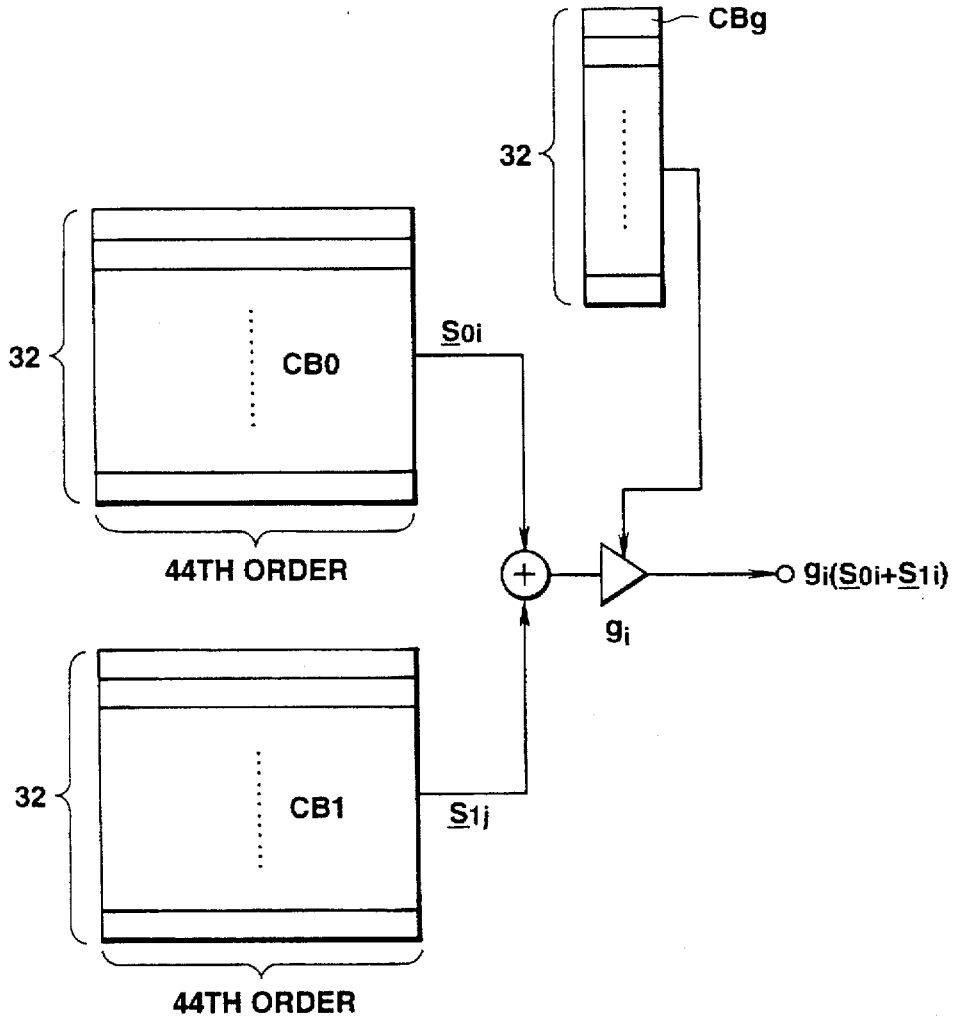
FIG. 3 illustrates the construction of a vector quantizer.

That is, the product of the sum of output vectors from the vector quantization codebook of 44 elements with the codebook size of 32 with a gain $g_i$ is used as a quantization value of 44-element spectral envelope vector $\underline{x}$. Referring to FIG. 3, two shape codebooks are CB0, CB1, with the output vector being $\underline{s}_{0i}$, $\underline{s}_{1j}$, where $0\leqq i$ and $j\leqq 31$. The output of the gain codebook CBg is $g_1$, where $0\leqq 1\leqq 31$, $g_1$ being a scalar value. The ultimate output is $g_i(\underline{s}_{0i}+\underline{s}_{1j})$.

The LPC residue in which the spectral envelope Am obtained by MBE analysis for the LPC residue is converted into a pre-set dimension is $\underline{x}$. It is crucial how $\underline{x}$ is to be quantized efficiently.

The quantization error energy E is defined as $$E=\|W\{H\underline{x}-Hg_1(\underline{s}_{0i}+\underline{s}_{1j})\}\|^2$$
$$=\|WH\{\underline{x}-g_1(\underline{s}_{0i}+\underline{s}_{1j})\}\|^2 \quad (1)$$

where H denotes characteristics on the frequency domain of a synthesis filter of LPC and W a matrix for weighting for representing of the weighting for taking account of the human hearing sense on the frequency axis.

With the α-parameter by the results of LPC analysis for the current frame being $a_i$ ($1 \leqq i \leqq P$), values of corresponding points of e.g., 44 dimensions are sampled from frequency characteristics of $$H(z)=\frac{1}{1+\sum_{i=1}^{P}\alpha_i z^{-i}} \quad (2)$$

As a procedure of calculation, 0s are stuffed in 1, $a_1$, $a_2$, . . . , $a_p$ to give 1, $a_1$, $a_2$, . . . 0, 0, . . . , 0 to provide e.g., 256-point data. 256-point FFT is executed to find $(r_e^2+I_m^2)^{1/2}$ for points corresponding to 0 to π and a reciprocal is found. A matrix having the reciprocals thinned to L points, e.g., 44 points, as diagonal elements, that is $$H=\begin{bmatrix} h(1) & & & 0 \\ [ & h(2) & & ] \\ & & \ddots & \\ 0 & & & h(L) \end{bmatrix}$$

is formed. The weighting matrix W for taking account of the human hearing sense is $$W(z)=\frac{1+\sum_{i}^{P}\alpha_i\lambda_b^i z^{-i}}{1+\sum_{i}^{P}\alpha_i\lambda_a^i z^{-i}} \quad (3)$$

where $a_i$ is the result of LPC analysis of the input and λa and λb are constants and, as an example, λa=0.4 and λb=0.9.

The matrix W may be calculated from the frequency characteristics of the equation (3). As an example, FFT is executed for 256-point data of 1, $a_1^{\lambda b}$, $a_2^{\lambda b2}$, . . . $a_1^{\lambda bp}$, 0, 0, . . . , 0 and $(r_2^2[i]+I_m^2[i])^{1/2}$ where $0 \leqq i \leqq 128$ is found for a domain of not less than 0 and not more than π. Then, for 1, $a_1\lambda bp$, $a_2 2\lambda a^2$, . . . , $a_p\lambda a^p$, 0, 0, . . . 0, the frequency characteristics of the denominator are found for 128 points for the domain of from 0 to π by 256-point FFT. This is to be $(r_e,^2[i]+I_m,^2[i])^{1/2}$ where $0 \leqq i \leqq 128$.

The frequency characteristics of the equation (3) may be found by $$w_0[i]=\frac{\sqrt{re^2[i]+Im^2[i]}}{\sqrt{re'^2[i]+Im'^2[i]}}$$

$$(0 \leqq i \leqq 128)$$

This is found by the following method for corresponding points of L-element, e.g., 44 element vector. Although linear interpolation should be used for correct calculation, substitution is made by the values of the closest points in the following example.

That is, $$\omega[i]=\omega_0[\mathrm{nint}(128i/L)], \text{ where } 1 \leqq i \leqq L$$

As for H, h(1), h(2), . . . , h(L) are found in a similar manner. That is, $$H=\begin{bmatrix} h(1) & & & 0 \\ [ & h(2) & & ] \\ & & \ddots & \\ 0 & & & h(L) \end{bmatrix} \quad (4)$$

$$W=\begin{bmatrix} w(1) & & & 0 \\ [ & w(2) & & ] \\ & & \ddots & \\ 0 & & & w(L) \end{bmatrix}$$

so $$WH=\begin{bmatrix} h(1)w(1) & & & 0 \\ [ & h(2)w(2) & & ] \\ & & \ddots & \\ 0 & & & h(L)w(L) \end{bmatrix}$$

Alternatively, H(z)W(z) is first found for decreasing the number of times of FFT before finding frequency characteristics. That is, $$H(z)W(z)=\frac{1}{1+\sum_{i=1}^{P}\alpha_i z^{-i}}\cdot\frac{1+\sum_{i=1}^{P}\alpha_i\lambda_b^i z^{-i}}{1+\sum_{i=1}^{P}\alpha_i\lambda_a^i z^{-i}} \quad (5)$$

The result of expanding the denominator of the equation (5) is $$\left(1+\sum_{i\leqq 1}^{P}\alpha_i z^{-i}\right)\left(1+\sum_{i=1}^{P}\alpha_i\lambda_a^i z^{-i}\right)=1+\sum_{i=1}^{2P}\beta_i z^{-i}$$

256-point data, that is 1, $\beta_1$, $\beta_2$, . . . , $\beta_{2p}$, 0, 0, . . . , 0 is prepared and 256-point FFT is executed. The frequency characteristics of the amplitudes are given as $$rms[i]=\sqrt{re''^2[i]+Im''^2[i]}$$

$$0 \leqq i \leqq 128$$

From this, $$wh_0=\frac{\sqrt{re^2[i]+Im^2[i]}}{\sqrt{re''^2[i]+Im''^2[i]}}$$

$$0 \leqq i \leqq 128$$

This is found for corresponding points of the L-element vector. If the number of FFT points is small, it should be found by linear interpolation. However, the closest points are herein employed. That is, $$wh[i]=wh_0\left[\mathrm{nint}\left(\frac{128}{L}\cdot i\right)\right]$$

$$1 \leqq i \leqq L$$

The matrix W' having this as diagonal element is $$W' = \begin{bmatrix} wh(1) & & & 0 \\ [ & wh(2) & & ] \\ & & \ddots & \\ 0 & & & wh(L) \end{bmatrix} \quad (6)$$

The equation (6) is the same matrix as the equation (4).

Rewriting the equation (1) using this matrix, that is the frequency characteristics of the weighting synthesis filter, we obtain $$E = \|W'(\underline{x} - g_i(\underline{s}_{0i} + \underline{s}_{1j}))\|^2 \quad (7)$$

The learning method of the shape codebook and the gain codebook is now explained.

As for the entire frames k which select the code vector $\underline{s}_{0c}$ concerning CB0, the expected value of the distortion is minimized. If there are M such frames, it suffices to minimize $$J = \frac{1}{M} \sum_{k=1}^{M} \|W'^k(x_k - g_k(s_{0c} + s_{1k}))\|^2 \quad (8)$$

where $W'_k$ is the weight to the k'th frame, $\underline{x}_k$ is an input to the k'th frame, $g_k$ is the gain of the k'th frame and $\underline{s}_k$ is an output of the codebook CB1 for the k'th frame.

For minimizing the equation (8), $$J = \frac{1}{M} \sum_{k=1}^{M} \{(x^{T_k} - g_k(s_{0c}^T + s_{1k}^T))W'^T_k W'_k(x_k - g_k(s_{0c} + s_{1k}))\} = \quad (9)$$

$$\frac{1}{M} \sum_{k=1}^{M} \{(x_k^T W'^T_k W'_k x_k - 2g_k(s_{0c}^T + s_{1k}^T)W'^T_k W'^T_k x_k + g_k^2(s_{0c}^T + s_{1k}^T)W'^T_k W_k(s_{0c} + s_{1k})\} =$$

$$\frac{1}{M} \sum_{k=1}^{M} \{x_k^T W'^T_k W'_k x_k - 2g_k(s_{0c}^T + s_{1k}^T)W'^T_k W'_k x_k + g_k^2 s_{0c}^T W'^T_k W_k s_{0c} + 2h_k^2 s_{0c}^T W'^T_k W'_k s_{1k} + g_k^2 s_{1k}^T W.$$

$$\frac{\partial J}{\partial s_{0c}} = \frac{1}{M} \sum_{k=1}^{M} \{-2g_k W'^T_k W'_k x_k + 2g_k^2 W'^T_k W_k s_{0c} + 2g_k^2 W'^T_k W_k s_{1k}\} = 0 \quad (10)$$

-continued $$\sum_{k=1}^{M} (g_k W'^T_k W'_k x_k - g_k^2 W'_k s_{1k}) = \sum_{k=1}^{M} g_k^2 W'^T_k W_k s_{0c}$$

Consequently, $$s_{0c} = \left\{ \sum_{k=1}^{M} g_k^2 W'^T_k W_k \right\}^{-1} \cdot \left\{ \sum_{k=1}^{M} g_k W_k^T W_k(x_k - g_k s_{1k}) \right\} \quad (11)$$

where $\{\ \}^{-1}$ denotes an inverse matrix and $W_k'^T$ is a transposed matrix of $W_k'$.

The gain optimization is now scrutinized.

The expected value $J_g$ of the distortion concerning the k'th frame selecting the code word $g_c$ of the gain is $$\sum_{k=1}^{M} x_k^T W'^T_k W'_k(s_{0k} + s_{1k}) = \sum_{k=1}^{M} g_c(s_{0k}^T + s_{1k}^T)W'^T_k W'_k(s_{0k} + s_{1k}) \quad (12)$$

$$g_c = \frac{\sum_{k=1}^{M} x_k^T W'^T_k W'_k(s_{0k} + s_{1k})}{\sum_{k=1}^{M} (s_{0k}^T + s_{1k}^T)W'^T_k W'_k(s_{0k} + s_{1k})}$$

by solving $$J_g = \frac{1}{M} \sum_{k=1}^{M} \|W'_k(x_k - g_c(s_{0k} + s_{1k}))\|^2 =$$

$$\frac{1}{M} \sum_{k=1}^{M} \{x_k^T W'^T_k W'_k x_k - 2g_c x_k^T W'^T_k W'_k(s_{0c} + s_{1k}) + g_c^2(s_{0k}^T + s_{1k}^T)W'^T_k W'_k(s_{0k} + s_{1k})\}$$

$$\frac{\partial J_g}{\partial g_c} = \frac{1}{M} \sum_{k=1}^{M} \{-2x_k^T W'^T_k W'_k(s_{0k} + s_{1k}) + 2g_c(s_{0k}^T + s_{1k}^T)W'^T_k W'_k(s_{0k} + s_{1k})\} = 0$$

The above equations (11) and (12) give optimum centroid condition for the shape $\underline{s}_{0i}$, $\underline{s}_{1i}$ and the gain $g_i$, $0 \leqq i \leqq 31$, that is optimum decoder output. The optimum decoder for $\underline{s}_{1i}$ may be found as that for $\underline{s}_{0i}$.

The optimum encoding condition (nearest neighbor condition) is now scrutinized.

$\underline{s}_{0i}$, $\underline{s}_{1i}$, which minimize the above equation (7) for the distortion scale, that is $E = \|W'(x - g_1(\underline{s}_{0i} + \underline{s}_{1i}))\|^{1/2}$, are determined every time the input $\underline{x}$ and the weight matrix W' are given, that is for each frame.

Inherently, E is to be found in a round-robin fashion for 32×32×32=32768 of the combinations of all of $g_1$, $(0 \leqq 1 \leqq 31)$, $\underline{s}_{0i}$ $(0 \leqq 1 \leqq 31)$, $\underline{s}_{g1j}$ $(0 \leqq 1 \leqq 31)$, in order to find a set of $g_1$, $\underline{s}_{0i}$ and $\underline{s}_{1i}$ which will give the minimum E. However, this entails voluminous arithmetic-logical operations. Thus, in the present embodiment, sequential search of the shape and gain is executed. This gives 32×32=1024 combinations. Meanwhile, round-robin search is done for the combinations of $\underline{s}_{0i}$ and $\underline{s}_{1i}$. For simplicity, $\underline{s}_{0i} + \underline{s}_{1i}$ is written as $\underline{s}_m$.

The above equation (7) becomes $E = \|W'(\underline{x} - g_1 s_m)\|^2$. If, for simplicity, we set so that $\underline{x}_W = W'\underline{x}$ and $\underline{s}_W = W'\underline{s}_m$, we obtain $$E = \|\bar{x}_w - g_i \bar{s}_w\|^2 \quad (13)$$

$$E = \|x_w\|^2 + \|s_w\|^2 \left( g_1 - \frac{x_w^T \cdot s_w}{\|s_w\|^2} \right)^2 - \frac{(x_w^T \cdot s_w)^2}{\|s_w\|^2} \quad (14)$$

Therefore, if assumed that $g_1$ can be sufficiently accurate, search may be made in two steps, namely (1) search for $\underline{s}_W$ which gives a maximum value of $$\frac{x_w^T \cdot s_w}{\|s_w\|^2}$$

and (2) search for $g_1$ closest to $$\frac{(x_w^T \cdot s_w)^2}{\|s_w\|^2}$$

The original expression may be rewritten to (1)' search for a combination of $\underline{s}_{0i}$, $\underline{s}_{1j}$ which gives a maximum value of $$\left(\frac{x^T W'^T W'(s_{0i}+s_{1j})}{\|W'(s_{0i}+s_{1j})\|^2}\right)^2 \tag{15}$$

and (2)' search for $g_1$ closest to $$\frac{x^T W'^T W'(s_{0i}+s_{1j})}{\|W'(s_{0i}+s_{1j})\|^2}$$

The equation (15) represents the optimum encoding condition (nearest neighbor condition).

The codebooks (CB0, CB1 and CBg) may be trained simultaneously by the generalized Lloyd algorithm (GLA) using the centroid conditions of the equations (11) and (12) and the condition of the equation (15).

In the embodiment of FIG. 1, the vector quantization circuit 23 is connected by a switching circuit 24 to a codebook 25V for voiced sound and to a codebook 25U for unvoiced sound. The changeover switch 24 is controlled by the V/UV discrimination output from the circuit 22 so that vector quantization is carried out using the codebook 25V or the codebook 25U for voiced sound and for the unvoiced sound, respectively.

The reason the codebooks are changed over depending upon V/UV discrimination is that, since weighted averaging by $W'_k$ and $g_1$ is employed in calculating new centroids of the equations (11) and (12), it is not desirable to average markedly different $W'_k$ and $g_1$ simultaneously.

In the present embodiment, W' divided by the norm of the input $\underline{x}$ is employed as W'. That is, $W'/\|\underline{x}\|$ is previously substituted for W' in the above equations (11), (12) and (15).

If the codebooks are changed over by V/UV, training data are distributed by a similar method so that the codebooks for V and UN may be prepared from the respective training data.

In the present embodiment, single band excitation (SBE) is used for decreasing the number of bits of V/UV and, if the content of V exceeds 50%, the frame is judged to be voiced and, if otherwise, the frame is judged to be unvoiced.

Figure 4:
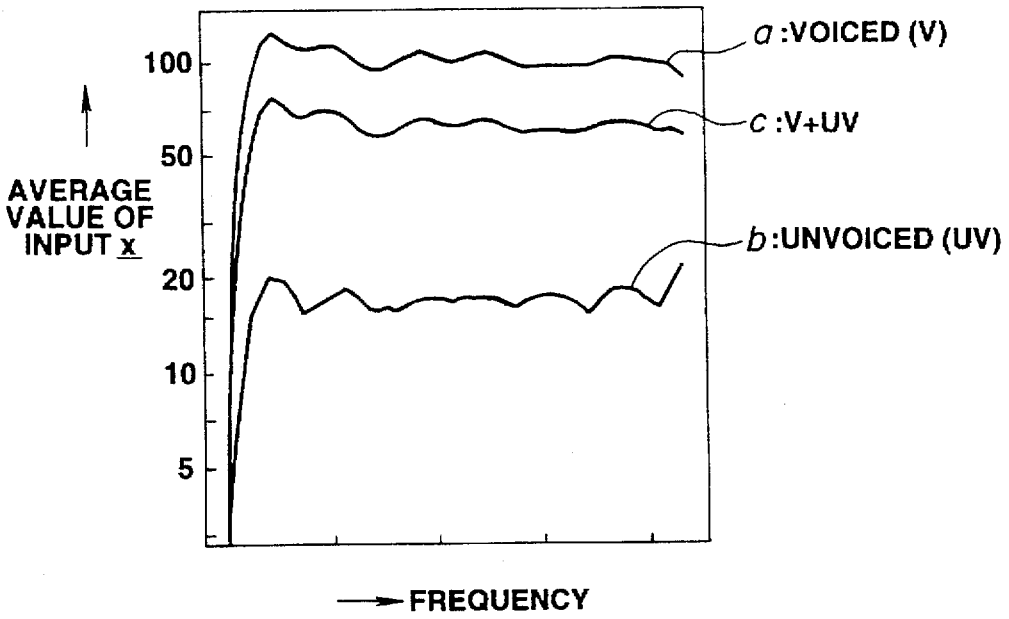
FIG. 4 is a graph showing mean values of an input $\underline{x}$ for each of the voiced sound, unvoiced sound and the voiced sound-unvoiced sound collected together.
Figure 5:
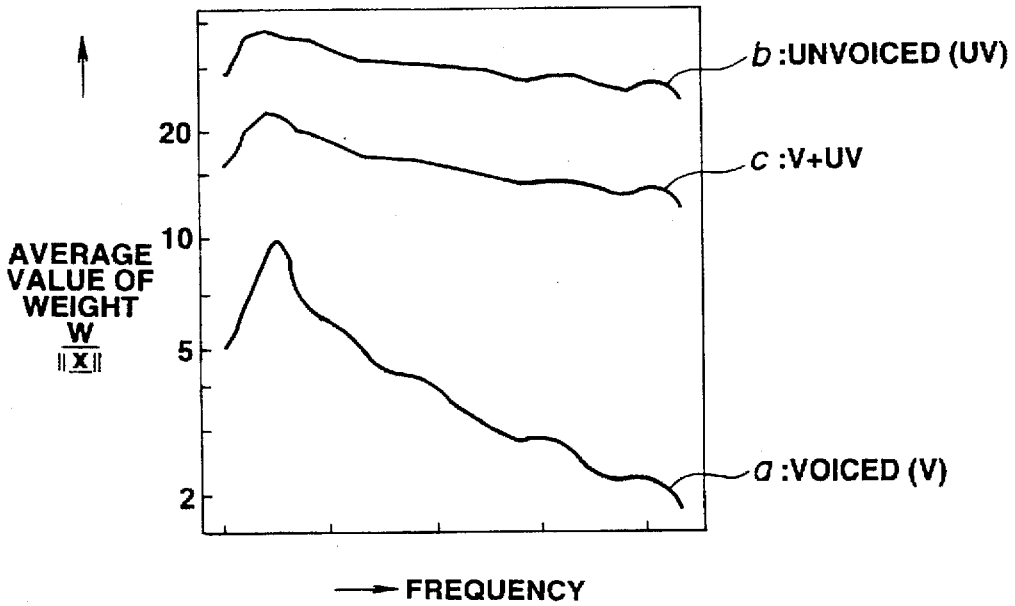
FIG. 5 is a graph showing mean values of weight $W'/\|\underline{x}\|$ for each of the voiced sound, unvoiced sound and the voiced sound-unvoiced sound collected together.

FIGS. 4 and 5 show the mean values of the input $\underline{x}$ and the weight $W'/\|\underline{x}\|$ for voiced sound (V), unvoiced sound (UV) and U-UV collected together, respectively.

It appears from FIG. 4 that the energy distribution of $\underline{x}$ itself on the frequency axis is not vitally different between U and UV and only the mean value of the gain ($\|\underline{x}\|$) is varied significantly. However, it is seen from FIG. 5 that the shape of the weight varies significantly between U and UV and that the weight for V is such weight as increases bit assignment for the low range as compared to that for UV. This accounts for the fact that a codebook of higher performance may be formulated by separate training for V and UV.

Figure 6:
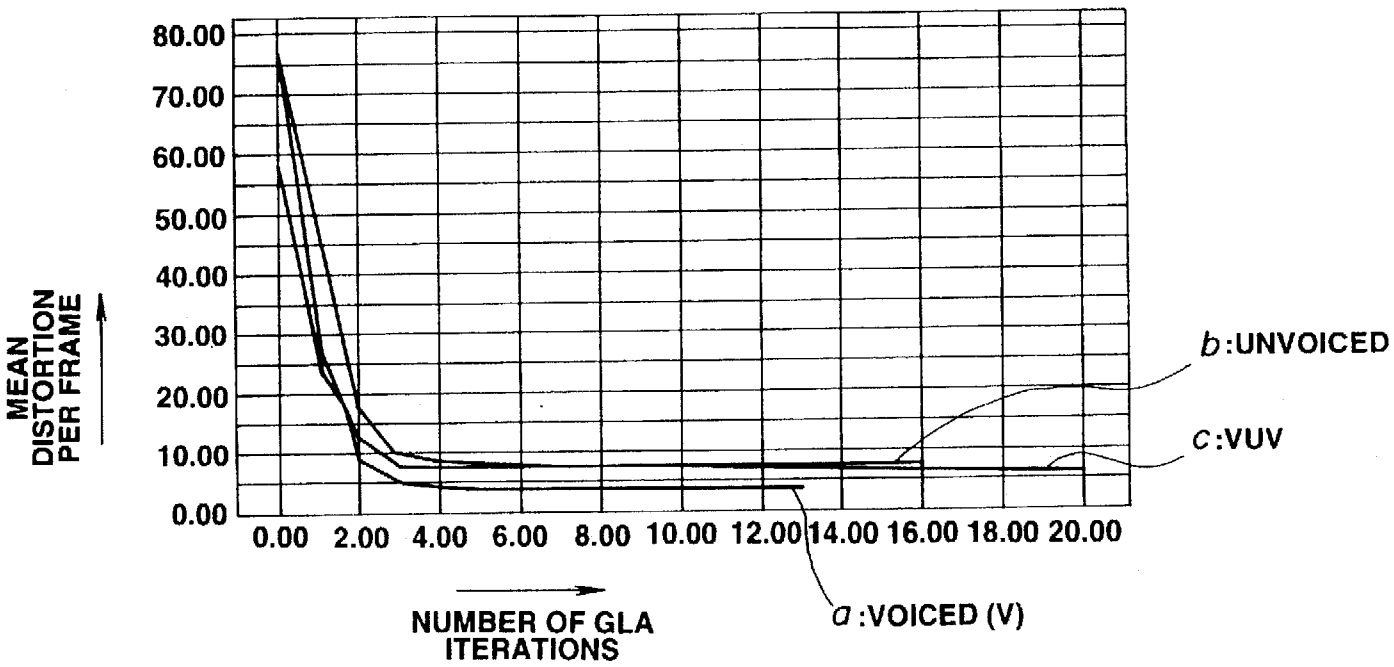
FIG. 6 shows the manner of training with a codebook employed for vector quantization for each of the voiced sound, unvoiced sound and the voiced sound-unvoiced sound collected together.

FIG. 6 shows the manner of training for only V, only UV and V-UV collected together. That is, FIG. 6 shows a curve a for only V, a curve $\underline{b}$ for only UV and a curve $\underline{c}$ for V-UV collected together, having terminal values of 3.72, 7.011 and 6.25, respectively.

It is seen from FIG. 6 that the separated training of the codebooks for V and UV leads to decreased expected values of the output distortion. Although the value for UV of curve $\underline{b}$ is slightly worse, the frequency for V/UV is improved on the whole since the domain for V is longer. As an example of the frequency of V/UV, if the training data length of V and UV is 1, the measured value of the proportion for V is 0.538, while that for UV is 0.462, such that, from the terminal values of the curves $\underline{a}$ and $\underline{b}$ of FIG. 6, 3.72×0.538+7.011×0.462=5,24 is an expected value of distortion on the whole. This value represents improvement of approximately 0.76 dB as compared to the expected value of 6.25 of the distortion for the case of collective training of V and UV together.

Judging from the manner of training, if the speech of four male and four female panellers, outside the training set, are processed and the SNR or SN ratio for the case of not performing quantization is taken, it may be recognized that segmental SNR may be improved by about 1.3 dB on an average by dividing the codebook into V and UV. This is presumably ascribable to the significantly higher ratio of V than for UV.

Meanwhile, the weight W' employed for weighting for taking account of the human hearing system during vector quantization by the vector quantizer 23 is defined by the equation (6). However, W' taking the temporal masking into account is found by finding the current W' by simultaneously taking account of past W'.

If, as to wh(1), wh(2), . . . w(h) in the equation (6), those calculated at time $\underline{n}$, that is at the n'th frame, are given as $wh_n(1), wh_n(2), \ldots, wh_n(L)$, and the weights taking account of past values at time n are defined as $A_n(i)$ , with $i \leqq i \leqq L$, $$A_n(i)=\lambda A_{n-1}(i)+(1-\lambda)wh_n(i) \text{ for } wh_n(i) \leqq A_{n-1}(i)$$

$$A(i)=wh_n(i) \text{ for } wh_n(i)>A_{n-1}(i)$$

where $\lambda$ may be set so that $\lambda=0.2$. The matrix having $A_n(i)$, $1 \leqq i \leqq L$ thus found as a diagonal element, may be used as the above weight.

Figure 7:
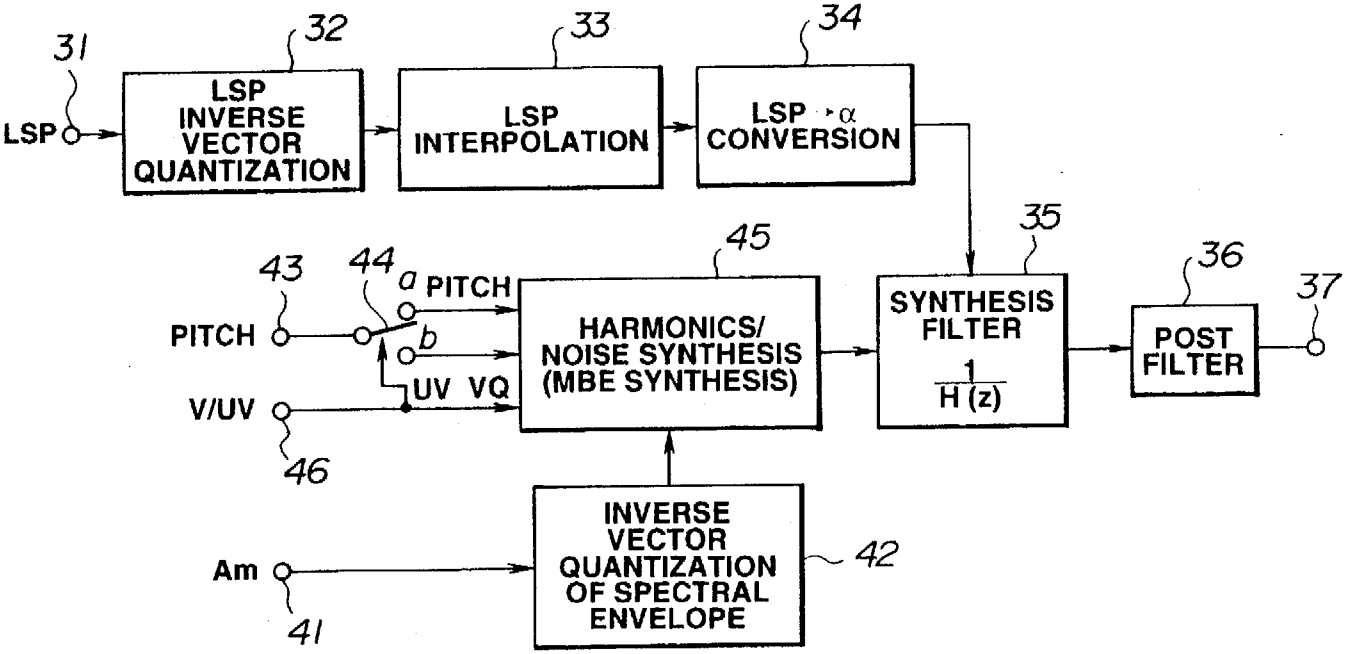
FIG. 7 is a schematic block diagram showing the construction of a speech signal decoder (decoding apparatus) for carrying out the decoding method according to the present invention.

FIG. 7 schematically shows the construction of a speech signal decoder for carrying out the speech decoding method according to the present invention.

Referring to FIG. 7, a vector quantized output of LSP, corresponding to an output of the terminal 31 of FIG. 1, that is an index, is supplied to a terminal 31.

This input signal is supplied to an LSP vector dequantizer 32 so as to be inverse vector quantized into LSP (linear spectral pair) data which is supplied to an LSP interpolation circuit 33 for LSP interpolation. The interpolated data is converted by an LSP to a conversion circuit 34 into an α-parameter of linear predictive codes (LPC). This α-parameter is sent to a synthesis filter 35.

The weighted vector quantized data of the spectral envelope (Am) corresponding to an output of a terminal 41 of the encoder of FIG. 1 is sent to a terminal 41 of FIG. 7. On the other hand, the pitch information from the terminal 43 of FIG. 1 and data specifying a characteristic quantity of the time waveform for UV are sent to a terminal 43 of FIG. 7, while V/UV discrimination data from the terminal 46 of FIG. 1 is sent to a terminal 46.

The vector quantized data Am from the terminal 41 is sent to a vector dequantizer 42 so as to be inverse vector quantized and turned into data of the spectral envelope data which is sent to a harmonics/noise synthesis circuit, such as an MBE circuit 45. Data from a terminal 43 is switched between pitch data and data corresponding to a characteristic quantity for UV waveform by a changeover switch 44 depending upon the V/UV discrimination data and transmitted to the synthesis circuit 45, which is also fed with V/UV discrimination data from a terminal 46.

Referring to FIG. 7, the construction of the MBE circuit, as an illustrative example of the synthesis circuit 45, is explained.

From the synthesis circuit 45, LPC residue data corresponding to an output of the back filtering circuit 21 of FIG. 1 are taken out and sent to a synthesis filter circuit 35 where LPC synthesis is carried out to form time waveform data which is then filtered by a post-filter 36 so as to be outputted as a time axis waveform signal at an output terminal 37.

Figure 8:
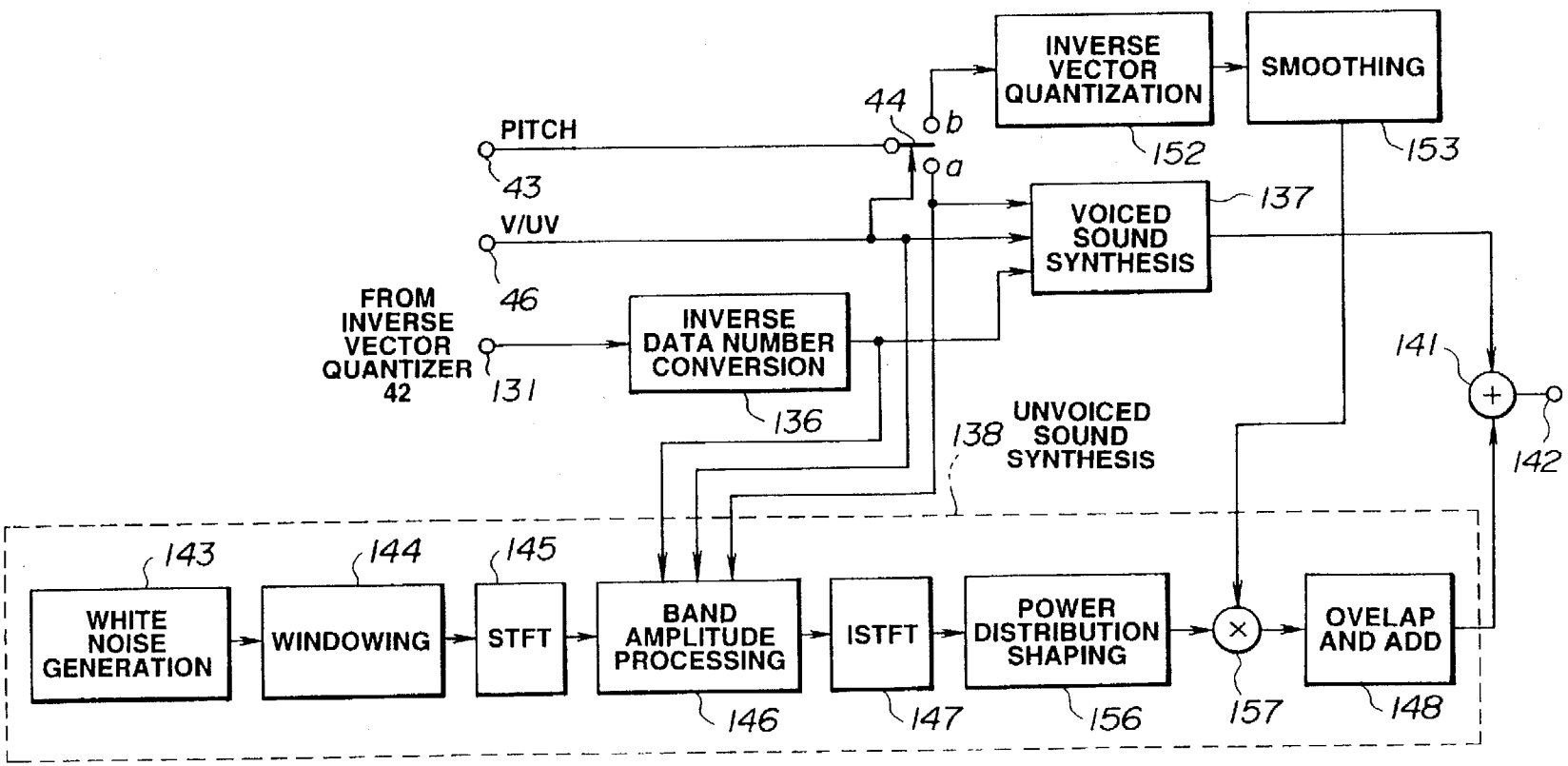
FIG. 8 is a block diagram showing the construction of a multi-band excitation (MBE) synthesis circuit as an illustrative example of a harmonics/noise synthesis circuit employed in FIG. 7.

Referring to FIG. 8, an illustrative example of an MBE synthesis circuit as an example of the synthesis circuit 45 is explained.

Referring to FIG. 8, spectral envelope data from the inverse vector quantizer 42 for the spectral envelope of FIG. 7, in effect the spectral envelope data of the LPC residues, are fed to an input terminal 131. Data supplied to the terminals 43, 46 are the same as those shown in FIG. 7. The data sent to the terminal 43 is switched and selected by the changeover switch 44, such that pitch data is sent to a voiced sound synthesis unit 137 while the data characteristic of the UV waveform are sent to an inverse vector quantizer 152.

The spectral amplitude data of the LPC residues from the terminal 131 are sent to and back-converted by a data number back-converting unit 136. The data number back-converting unit 136 effects back-conversion which is comparable to that performed by the data number converting unit 119 to produce amplitude data which is sent to the voiced sound synthesis circuit 137 and to an unvoiced sound synthesis circuit 138. The pitch data produced via the fixed terminal a of the changeover switch 44 via the terminal 43 is sent to the voiced sound synthesis circuit 137 and to the unvoiced sound synthesis circuit 138. The V/UV discrimination data from the terminal 46 is also sent to the voiced sound synthesis circuit 137 and to the unvoiced sound synthesis circuit 138.

The voiced sound synthesis unit 137 synthesizes the voiced waveform on the time axis by e.g., cosine wave synthesis or sine wave synthesis. The unvoiced sound synthesis unit 138 synthesizes the unvoiced waveform on the time axis by filtering the white noise by e.g., a bandpass filter. The synthesized voiced waveform and the synthesized unvoiced waveform are summed by an addition unit 141 so as to be taken out at an output terminal 142.

If the V/UV code is transmitted as the V/UV discrimination data, the entire band may be classified at a demarcation point into a voiced area and an unvoiced area depending upon the V/UV code. The band-based V/UV discrimination data may be produced depending upon this demarcation. Of course, if the number of bands is degraded on the analysis or encoder side into a pre-set number, such as 12, it may be resolved or restored to provide a varying number of bands with an interval corresponding to the original pitch.

The operation of synthesis of unvoiced sound by the unvoiced sound synthesis unit 138 is now explained.

The white noise signal waveform from a white noise generator 143 is sent to a windowing unit 144 so as to be multiplied by a suitable windowing function, such as a Humming window, at a pre-set length, such as 256 samples, by way of windowing. The windowed signal waveform is processed with short-term Fourier transform (STFT,) by an STFT unit 145 for producing the power spectrum of the white noise on the frequency axis. The power spectrum from the STFT unit 145 is sent to a band amplitude processor 146 where the band found to be unvoiced is multiplied by the amplitude $|A_m|_{UV}$ while the band found to be voiced is set to an amplitude value equal to zero. The band amplitude processor 146 is fed with the amplitude data, pitch data and V/UV discrimination data.

An output of the band amplitude processor 146 is sent to an ISTFT unit 147. The phase is inverse STFTed using the phase of the original white noise so as to be converted into the time-axis signals. An output of the ISTFT unit 147 is sent to an overlap-add unit 148 via a power distribution shaping unit 156 and a multiplier 157 as later explained so as to be suitably weighted for restoring the original continuous noise waveform and so as to be repeatedly overlap-added in order to synthesize the continuous time-axis waveform. An output of the overlap-add circuit 148 is sent to the addition unit 141.

If at least one of the bands in a block is voiced, the above processing is carried out by the synthesis units 137, 138, If all of the bands in the block are found to be unvoiced, the changeover switch 44 is set to the fixed terminal b so that the information concerning the time waveform of the unvoiced signal is sent to the vector quantization unit 152 in place of the pitch information.

That is, data equivalent to data from the vector quantization unit 127 of FIG. 2 is supplied to the inverse vector quantization unit 152. These data are inverse vector quantized in order to take out data corresponding to characteristic quantity of the unvoiced signal waveform.

An output of the ISTFT unit 147 is shaped as to energy distribution along the time axis by the power distribution shaping unit 156 and thence supplied to a multiplier 157 which multiplies the output of the unit 147 with a signal sent from the vector dequantization unit 152 via a smoothing unit 153. The smoothing operation by the smoothing circuit suppresses harsh sounding abrupt gain changes.

The unvoiced sound thus synthesized is taken out at the unvoiced sound synthesis unit 138 and sent to the addition unit 141 where it is summed to the signal from the voiced sound synthesis unit 137 so that the LPC residue signal as MBE synthesized output is taken out at the output terminal 142.

The LPC residue signal is sent to the synthesis filter 35 of FIG. 7 in order to produce the ultimate playback speech signal.

Figure 9:
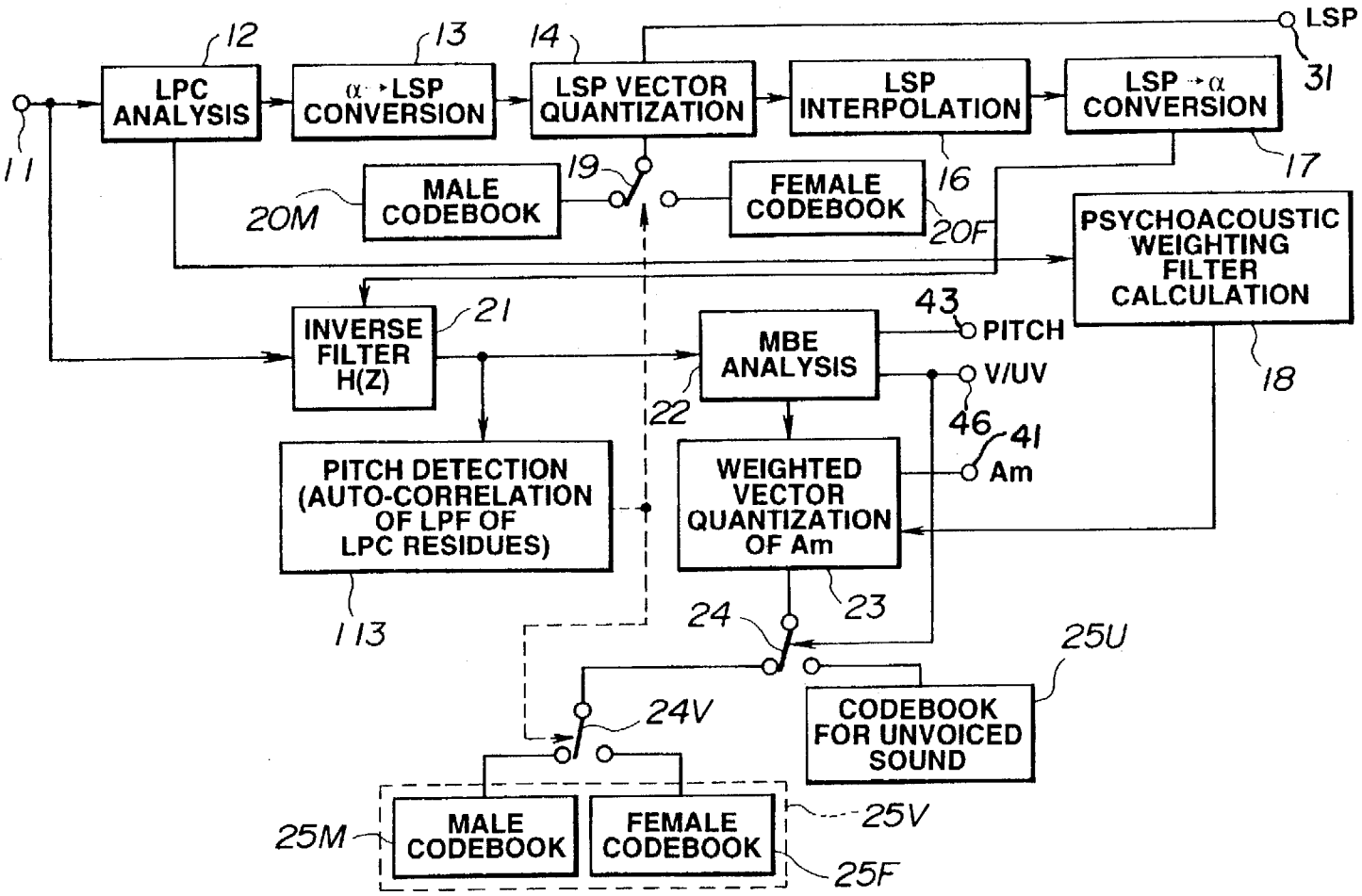
FIG. 9 is a schematic block diagram showing another speech signal encoder (encoding apparatus) for carrying out the encoding method according to the present invention.

FIG. 9 shows a further embodiment of the present invention in which the codebook of the LSP vector quantizer 14 in the encoder configuration shown in FIG. 1 is divided into a codebook for male speech 20M and a codebook for female speech 20F, while the codebook for voiced speech of the weighting vector quantizer 23 with an amplitude Am is divided into a codebook for male speech 25M and a codebook for female speech 25F. In FIG. 9, parts or components similar to those of FIG. 1 are depicted by the same reference numerals and the corresponding description is omitted for clarity. The male speech and the female speech represent features of the male speech and the female speech and are not directly relevant to whether the actual speaker is a male speaker or a female speaker.

Referring to FIG. 9, the LSP vector quantizer 14 is connected via a changeover switch 19 to the codebook for male speech 20M and to the codebook for female speech 20F. The codebook for voiced sound 25V, connected to the weighting quantizer for Am 23, is connected via a changeover switch 24V to the codebook for male speech 25M and to the codebook for female speech 25F.

These changeover switches 19, 24V are controlled in dependence upon the result of discrimination of the male speech or the female speech by e.g., the pitch as found in the pitch extraction unit of FIG. 2 or the pitch detection unit 113 of FIG. 2, so that, if the result of discrimination indicates the male speech, the changeover switches are connected to the codebooks 20M, 25M for male speech and, if the result of discrimination indicates the female speech, the changeover switches are connected to the codebooks 20F, 25F for female speech.

The discrimination between the male speech and the female speech is mainly achieved by discriminating the magnitude of the pitch itself by comparison with a pre-set threshold value. In addition, reliability in pitch detection by the pitch intensity or the frame power is also taken into account, while the mean value of several past frames exhibiting a stable pitch domain is compared to a pre-set threshold in ultimately discriminating the male speech and the female speech.

By switching the codebook depending upon whether the speech is the male speech or the female speech, it becomes possible to improve quantization characteristics without increasing the transmission bit rate. The reason is that, since there is a difference between the male speech and the female speech as to the distribution of the formant frequency of the vowel sound, the space in which the vector to be quantized is decreased by switching between the male speech and the female speech especially in the vowel portion, that is the vector dispersion is decreased, thus enabling satisfactory training and reducing the quantization error.

The discrimination between the male speech and the female speech need not necessarily be coincident with the sex of the speaker such that it suffices if the codebook selection is done in accordance with the same reference as that for training data distribution. The appellation of the codebook for male speech and the codebook for female speech is used herein merely for convenience for explanation.

The following advantages are derived by employing the above-described speech encoding/decoding method.

First, since the minimum phase transition-total polarity filter is used during LPC synthesis, the ultimate output substantially proves to be the minimum phase even if zero phase synthesis is done without transmitting the phase of the MBE analysis/synthesis itself, so that the "stuffed" feeling proper to MBE is lowered and the synthesized sound higher in clarity may be produced.

Second, the analysis/synthesis of MBE gives a substantially flat spectral envelope, the probability is low that, in the dimensional conversion for vector quantization, the quantization error caused by vector quantization be enlarged by dimensional conversion.

Third, since enhancement by the characteristic quantity of the time waveform of the unvoiced sound portion is done substantially on the white noise, and the LPC synthesis filter is subsequently traversed, the enhancement by the UV portion becomes effective to increase the clarity of the speech.

The present invention is not limited to the above-described embodiments. For example, while the construction of the speech analysis or encoding side of FIGS. 1 and 2 or the construction of the speech synthesis or decoder side of FIGS. 7 and 8 are described as being the hardware, they may also be implemented by software using a digital signal processor (DSP). In place of vector quantization, data of plural frames may be collected and processed with matrix quantization. In addition, the speech encoding method or the speech decoding method according to the present invention is not limited to the method for speech analysis/synthesis employing multi-band excitation and may be applied to variety of speech analysis/synthesis methods which employ sine wave synthesis or noise signals for synthesis of the voiced portion or the unvoiced portion. Furthermore, the present invention is not limited to applications for transmission, recording or reproduction, and may be used for applications such as pitch or speed conversion or noise suppression.

What is claimed is:

1. A speech encoding method which divides an input speech signal into blocks on a time axis and encodes the input speech signal on a block basis, the speech encoding method comprising the steps of:

finding a short-term prediction residue of the input speech signal;

representing the short-term prediction residue by at least a sum of sine waves; and encoding information of a frequency spectrum of the sum of the sine waves, wherein the frequency spectrum is processed by matrix quantization or vector quantization with weighting that takes into account factors relating to human hearing sense.

2. The speech encoding method as claimed in claim 1, further comprising the step of discriminating whether the input speech signal is a voiced sound signal or an unvoiced sound signal, wherein a set of parameters for sine wave synthesis is extracted in a portion of the input speech signal found to be voiced and a frequency component of noise is modified in a portion of the input speech signal found to be unvoiced in order to synthesize an unvoiced sound.

3. The speech encoding method as claimed in claim 2, wherein the step of discriminating between the voiced sound signal and the unvoiced sound signal is done on a block basis.

4. The speech encoding method as claimed in claim 3, wherein each block contains spectral information divided into bands and the step of discriminating between the voiced sound signal and the unvoiced sound signal is done on a band basis.

5. The speech encoding method as claimed in claim 1, wherein a linear predictive coding (LPC) residue by linear prediction analysis is used as the short-term prediction residue, and further comprising the step of outputting respective parameters representing LPC coefficients, pitch information representing a basic period of the LPC residue, index information from vector quantization or matrix quantization of a spectral envelope of the LPC residue, and information indicating whether the input speech signal is voiced or unvoiced.

6. The speech encoding method as claimed in claim 5, wherein for an unvoiced portion of the sound signal, information indicating a characteristic quantity of a LPC residual waveform is output in place of the pitch information.

7. The speech encoding method as claimed in claim 6, wherein the information indicating the characteristic quantity is an index of a vector indicating a short-term energy sequence of the LPC residual waveform in one block.

8. The speech encoding method as claimed in claim 2, wherein, depending upon a result of the discrimination step, a codebook for processing by matrix quantization or vector quantization with weighting that takes into account factors relating to human hearing sense is switched between a codebook for voiced sound and a codebook for unvoiced sound.

9. The speech encoding method as claimed in claim 8, wherein for the weighting that takes into account factors relating to human hearing sense, a weighting coefficient of a past block is used in calculating a current weighting coefficient.

10. The speech encoding method as claimed in claim 1, wherein a codebook for matrix quantization or vector quantization of the frequency spectrum is one of a codebook for male speech and a codebook for female speech and a switching selection is made between the codebook for male speech and the codebook for female speech depending upon whether the input speech signal is a male speech signal or a female speech signal.

11. The speech encoding method as claimed in claim 5, wherein a codebook for matrix quantization or vector quantization of the parameter representing the LPC coefficients is one of a codebook for male speech or a codebook for female speech, and a switch is made between the codebook for male speech and the codebook for female speech depending upon whether the input speech signal is a male speech signal or a female speech signal.

12. The speech encoding method as claimed in claim 10, wherein a pitch of the input speech signal is detected and is discriminated to determine whether the input speech signal is the male speech signal or the female speech signal and, based upon the discrimination of the detected pitch, a switch is made between the codebook for male speech and the codebook for female speech.

13. A method for decoding an encoded speech signal formed using a short-term prediction residue of an input speech signal which is divided on a time axis on a block basis, the short-term prediction residue being represented by a sum of sine waves on the block basis, wherein information of a frequency spectrum of the sum of the sine waves is encoded to form the encoded speech signal to be decoded, the method for decoding comprising the steps of:

finding a short-term prediction residual waveform by sine wave synthesis of the encoded speech signal by converting a fixed number of data of the frequency spectrum into a variable number thereof, wherein the encoded speech signal is encoded by matrix quantization or vector quantization with weighting that takes into account factors relating to human hearing sense; and synthesizing a time-axis waveform signal based on the short-term prediction residual waveform of the encoded speech signal.

14. The speech decoding method as claimed in claim 13, wherein a linear predictive coding (LPC) residue by linear prediction analysis is used as the short-term prediction residue, and respective parameters representing LPC coefficients, pitch information representing a basic period of the LPC residue, index information from vector quantization or matrix quantization of a spectral envelope of the LPC residue, and information indicating whether the input speech signal is voiced or unvoiced are included in the encoded speech signal.

15. A speech encoding/decoding method comprising the steps of:

dividing an input speech signal on a time axis into blocks;

encoding the input speech signal on a block basis; and decoding the encoded speech signal, wherein the step of encoding comprises sub-steps of finding a short-term prediction residue of the input speech signal, representing the short-term prediction residue by a sum of sine waves, and encoding information of a frequency spectrum of the sum of the sine waves, wherein the frequency spectrum is processed by matrix quantization or vector quantization with weighting that takes into account factors relating to human hearing sense, and the step of decoding comprises sub-steps of finding a short-term prediction residual waveform of the encoded speech signal by sine wave synthesis, synthesizing a time-axis waveform signal based on the short-term prediction residual waveform of the encoded speech signal.

16. The speech encoding/decoding method as claimed in claim 15, further comprising the step of discriminating whether the input speech signal is a voiced sound signal or an unvoiced sound signal, wherein a the sum of the sine waves is synthesized in a portion of the input speech signal found to be voiced and a frequency component of noise is modified in a portion of the input speech signal found to be unvoiced in order to synthesize an unvoiced sound.

17. The speech encoding/decoding method as claimed in claim 16, wherein the step of discriminating between the voiced sound signal and the unvoiced sound signal is done on a block basis.

18. The speech encoding/decoding method as claimed in claim 15, wherein a linear predictive coding (LPC) residue by linear prediction analysis is used as the short-term prediction residue, and further comprising the step of outputting respective parameters representing LPC coefficients, pitch information representing a basic period of the LPC residue, index information from vector quantization or matrix quantization of a spectral envelope of the LPC residue, and information indicating whether the input speech signal is voiced or unvoiced.

19. The speech encoding/decoding method as claimed in claim 18, wherein for an unvoiced sound signal information indicating a characteristic quantity of a LPC residual waveform is output in place of the pitch information.

20. The speech encoding/decoding method as claimed in claim 19, wherein the information indicating the characteristic quantity is an index of a vector indicating a short-term energy sequence of the LPC residual waveform in one block.

21. The speech encoding/decoding method as claimed in claim 16, wherein, depending upon a result of the discrimination step, a codebook for matrix quantization or vector quantization with weighting that takes into account factors relating to human hearing sense is switched between a codebook for voiced sound and a codebook for unvoiced sound.

22. The speech encoding/decoding method as claimed in claim 21, wherein for the weighting that takes into account factors relating to human hearing sense a weighting coefficient of a past block is used in calculating a current weighting coefficient.

23. The speech encoding/decoding method as claimed in claim 15, wherein a codebook for matrix quantization or vector quantization of the frequency spectrum is one of a codebook for male speech and a codebook for female speech, and a switch is made between the codebook for male speech and the codebook for female speech depending upon whether the input speech signal is a male speech signal or a female speech signal.

24. The speech encoding/decoding method as claimed in claim 18, wherein a codebook for matrix quantization or vector quantization of the parameter specifying the LPC coefficients is one of a codebook for male speech or a codebook for female speech, and a switch is made between the codebook for male speech and the codebook for female speech depending upon whether the input speech signal is a male speech signal or a female speech signal.

25. The speech encoding/decoding method as claimed in claim 23, wherein a pitch of the input speech signal is detected and is discriminated to determine whether the input speech signal is the male speech signal or the female speech signal and, based upon the discrimination of the detected pitch, a switch is made between the codebook for male speech and the codebook for female speech.

26. A speech encoding apparatus for dividing an input speech signal into blocks on a time axis and encoding the signal on a block basis, the encoding apparatus comprising:

computation means for finding a short-term prediction residue of the input speech signal;

analysis means for representing the short-term prediction residue by a sum of sine waves;

means for encoding information of a frequency spectrum of the sum of the sine waves: and weighting means for quantizing the frequency spectrum by matrix quantization or vector quantization with weighting that takes into account factors relating to human hearing sense.

27. The speech encoding apparatus as claimed in claim 26, wherein the analysis means includes means for discriminating whether the input speech signal is a voiced sound signal or an unvoiced sound signal, and wherein a set of parameters for sine wave synthesis is extracted by the analysis means in a portion of the speech signal found to be voiced and modifies a frequency component of noise in a portion of the speech signal found to be unvoiced in order to synthesize an unvoiced sound.

28. The speech encoding apparatus as claimed in claim 27, wherein the discriminating means discriminates between the voiced sound signal and the unvoiced sound signal on a block basis.

29. The speech encoding apparatus as claimed in claim 28, wherein each block contains spectral information divided into bands and discrimination between the voiced sound signal and the unvoiced sound signal is done on a band basis.

30. The speech encoding apparatus as claimed in claim 26, wherein the computation means outputs a linear predictive code (LPC) residue by linear prediction analysis as the short-term prediction residue, and wherein the analysis means outputs respective parameters representing LPC coefficients, pitch information representing a basic period of the LPC residue, index information from weighted vector quantization or matrix quantization of a spectral envelope of the LPC residue, and information indicating whether the input speech signal is voiced or unvoiced.

31. The speech encoding apparatus as claimed in claim 30, wherein for an unvoiced portion of the input speech signal, information indicating a characteristic quantity of an LPC residual waveform is output in place of the pitch information.

32. The speech encoding apparatus as claimed in claim 31, wherein the information indicating the characteristic quantity is an index of a vector indicating a short-term energy sequence of the LPC residual waveform in one block.

33. The speech encoding apparatus as claimed in claim 26, wherein a codebook for the matrix quantization or vector quantization with weighting that takes into account factors relating to hearing sense is switched by the weighting means between a codebook for voiced sound and a codebook for unvoiced sound depending upon whether the analysis/synthesis means discriminates the input speech signal to be voiced or unvoiced.

34. The speech encoding apparatus as claimed in claim 26, wherein the weighting means uses a weighting coefficient of a past block in calculating a current weighting coefficient.

35. The speech encoding apparatus as claimed in claim 26, wherein a codebook for matrix quantization or vector quantization of the frequency spectrum is one of a codebook for male speech and a codebook for female speech, and a switch is made between the codebook for male speech and the codebook for female speech depending upon whether the input speech signal is a male speech signal or a female speech signal.

36. The speech encoding apparatus as claimed in claim 26, wherein the weighting means employs a codebook for matrix quantization or vector quantization of the parameter specifying the LPC coefficients, one of a codebook for male speech and a codebook for female speech is used, and a switch is made between the codebook for male speech and the codebook for female speech depending upon whether the input speech signal is a male speech signal or a female speech signal.

37. The speech encoding apparatus as claimed in claim 36, further comprising detection means for N detecting a pitch of the input speech signal and for determining whether the input speech signal is the male speech signal or the female speech signal, and wherein the weighting means effects a switch between the codebook for male speech and the codebook for female speech based on the pitch of the input speech signal detected by the detection means.

38. A speech decoding apparatus for decoding an encoded speech signal formed using a short-term prediction residue of an input speech signal divided on a time axis on a block basis, the short-term prediction residue represented by a sum of sine waves on the block basis, wherein information of a frequency spectrum of the sum of the sine waves is encoded to form the encoded speech signal to be decoded, the decoding apparatus comprising:

computation means for finding a short-term prediction residual waveform by sine wave synthesis of the encoded speech signal by converting a fixed number of data of the frequency spectrum into a variable number thereof, wherein the encoded speech signal is encoded by matrix quantization or vector quantization with weighting that takes into account factors relating to human hearing sense; and synthesizing means for synthesizing a time-axis waveform signal based on the short-term residual waveform.

39. The speech decoding apparatus as claimed in claim 38, wherein the computation means outputs a linear predictive coding (LPC) residue as the short-term prediction residue, and wherein the synthesizing means employs as the encoded speech signal parameters respectively representing LPC coefficients, pitch information representing a basic period of the LPC residue, index information from vector quantization or matrix quantization of a spectral envelope of the LPC residue and information indicating whether the input speech signal is voice or unvoiced.

* * * * *